US007036921B2

(12) United States Patent
Kanome

(10) Patent No.: US 7,036,921 B2
(45) Date of Patent: May 2, 2006

(54) SHEET CONVEYING METHOD, SHEET ATTRACTING CONVEYING APPARATUS AND RECORDING APPARATUS

(75) Inventor: Osamu Kanome, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 89 days.

(21) Appl. No.: 10/241,630

(22) Filed: Sep. 12, 2002

(65) Prior Publication Data

US 2003/0052955 A1 Mar. 20, 2003

(30) Foreign Application Priority Data

Sep. 17, 2001 (JP) ..... 2001-281503
Jul. 23, 2002 (JP) ..... 2002-213534

(51) Int. Cl.
*B41J 2/01* (2006.01)

(52) U.S. Cl. ..... 347/104; 271/193
(58) Field of Classification Search ..... 347/104; 271/193; 355/208
See application file for complete search history.

(56) References Cited

U.S. PATENT DOCUMENTS 5,121,170 A * 6/1992 Bannai et al. ..... 355/326
5,276,483 A * 1/1994 Hasegawa et al. ..... 355/208
5,316,282 A * 5/1994 Fukube et al. ..... 271/10
5,949,443 A * 9/1999 Yamamoto et al. ..... 347/3
6,014,537 A * 1/2000 Van et al. ..... 399/271
6,164,761 A 12/2000 Numata
6,511,172 B1 * 1/2003 Tano ..... 347/104

FOREIGN PATENT DOCUMENTS

EP 0 473 178 3/1992
JP 5-8392 1/1993
JP 406161298 * 6/1994

* cited by examiner

*Primary Examiner*—Manish S. Shah
*Assistant Examiner*—Ly Tran
(74) *Attorney, Agent, or Firm*—Fitzpatrick, Cella, Harper & Scinto

(57) ABSTRACT

The present invention relates to a sheet conveying apparatus and method using a conveyance belt formed with a plurality of electrodes for attracting a sheet with electrostatic force. The electrodes are applied with a voltage changed along with the lapse of time for generating an attraction force, and the integral value of voltage applied to one electrode has a polarity different from that of the integral value of voltage applied to another adjacent electrode.

19 Claims, 7 Drawing Sheets

250Hz

SHEET CONVEYING METHOD, SHEET ATTRACTING CONVEYING APPARATUS AND RECORDING APPARATUS

BACKGROUND OF THE INVENTION

1. Field of the Invention

This invention relates to a recording apparatus, a sheet conveying method for the recording apparatus, and a sheet attracting conveying device for the recording apparatus.

2. Description of Related Art

Among inkjet recording apparatuses, an inkjet recording apparatus using a full-line type recording head can record at high speed with high definition. A generally known method for attracting and conveying a conveying object is to dispose an electrically conductive electrode in the recording apparatus and create an electrostatic force by applying an electric charge to the electrode.

A description of prior art is given hereinafter with reference to FIG. 4 and FIG. 5. FIG. 4 is a cross-sectional view of a conveyance belt. The conveyance belt includes a first electrode 36*a* and a second electrode 36*b*, which are formed of electrically conductive resins, a base layer 36*c*, and a surface layer. In FIG. 5, a voltage supplying means includes a voltage supplying brush 51 contacting with a voltage receiving portion for supplying electric charge thereto, a voltage supplying electrode 52, and a support member 53. The surface layer and the voltage receiving portion 36*e* form a flat plane. Electric charge is supplied constantly from the voltage supplying brush 51 to the first electrode 36*a* for creating an electrostatic force. Therefore, a suitable and a constant attraction force can be generated.

However, the comb-teeth electrode of the conventional conveying apparatus, in general, being constantly applied with same voltage raises problems such as staining of an image due to ink mist attracted to the proximity of the electrode or blurring of an image due to ink droplets deviating from a targeted impact area.

SUMMARY OF THE INVENTION

It is an object of this invention to prevent mist adhering upon a sheet and to prevent impact deviation of ink droplets.

In means to achieve the foregoing object, a representative structure of this invention is a sheet conveying method in use of a conveyance belt formed with a plurality of electrodes for attracting a sheet with electrostatic force, wherein the electrodes are applied with a voltage changed along with the lapse of time for generating attraction force, and wherein the integral value of voltage applied to one electrode has a polarity different from that of the integral value of voltage applied to another adjacent electrode.

Adherence of ink mist upon a recording paper and impact deviation of ink droplets can be prevented since the sheet conveying method of this invention is characterized by using a conveyance belt formed with a plurality of electrodes for attracting a sheet with electrostatic force, wherein the electrodes are applied with a voltage changed along with the lapse of time for generating attraction force, and wherein the integral value of voltage applied to one electrode has a polarity different from that of the integral value of voltage applied to another adjacent electrode.

BRIEF DESCRIPTION OF THE DRAWINGS

The above and other objects and features of the invention will be apparent to those skilled in the art from the following preferred embodiments thereof when considered in conjunction with the accompanying drawings, in which.

DESCRIPTION OF THE PREFERRED EMBODIMENTS

First Embodiment

Figure 1:
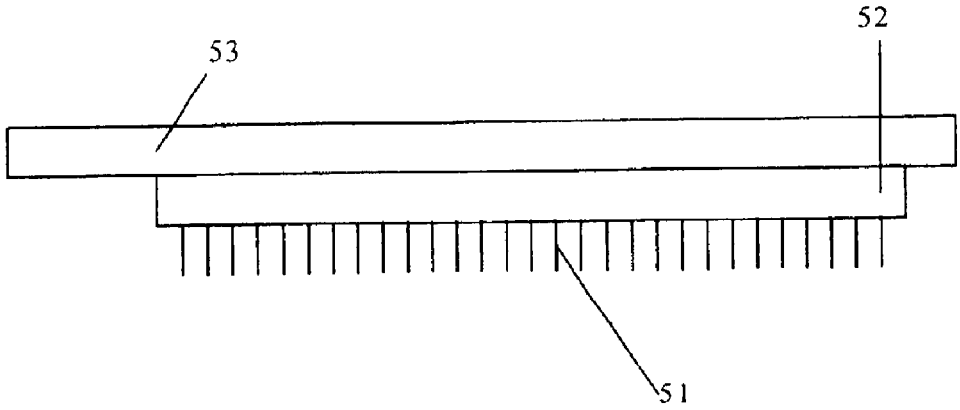
FIG. 1 is an explanatory view showing an attraction force generating means.

FIG. 1 is an explanatory view showing a voltage supplying means of this invention. The voltage supplying means includes a voltage supplying brush 51, a voltage supplying electrode 52, and a support member 53. The right side of FIG. 1 is the sheet feeding side and the left side thereof is the sheet delivery side, wherein a recording paper P (sheet) is conveyed from the right side to the left side of FIG. 1. The voltage supplying brush 51 contacts with a voltage receiving portion of a belt and supplies electric voltage to the voltage receiving portion of the belt.

Figure 2:
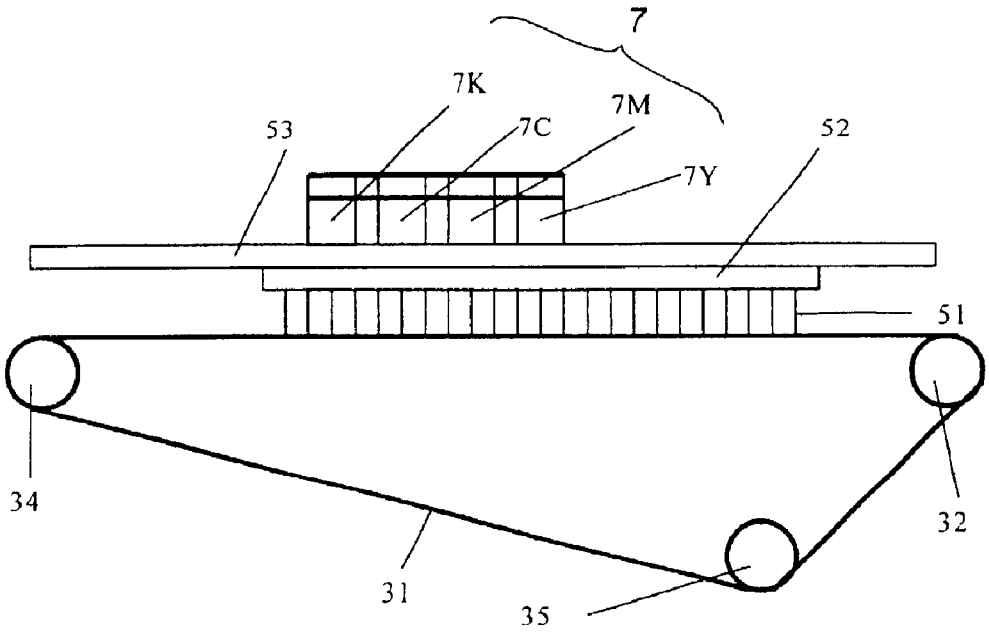
FIG. 2 is an explanatory view showing the positional relation among an attraction force generating means, a conveyance belt and a recording head.

FIG. 2 is an explanatory view showing the positional relation among a voltage supplying means, a conveyance belt serving as a sheet conveying means, and a recording head 7 serving as a recording means. A conveyed recording paper P is attracted to the belt. At the area where the paper P begins to pass beneath a recording head 7Y, the recording paper P is attracted to the belt with a prescribed voltage. The recording heads are aligned at intervals of 2 cm, and the width of each recording head in the conveying direction is 2 cm. The length of the voltage supplying electrode 52, which is 20 cm, is the necessary and sufficient length for supplying voltage from the beginning of the recording head 7Y arranged most upstream to a recording head 7K arranged most downstream.

Figure 3:
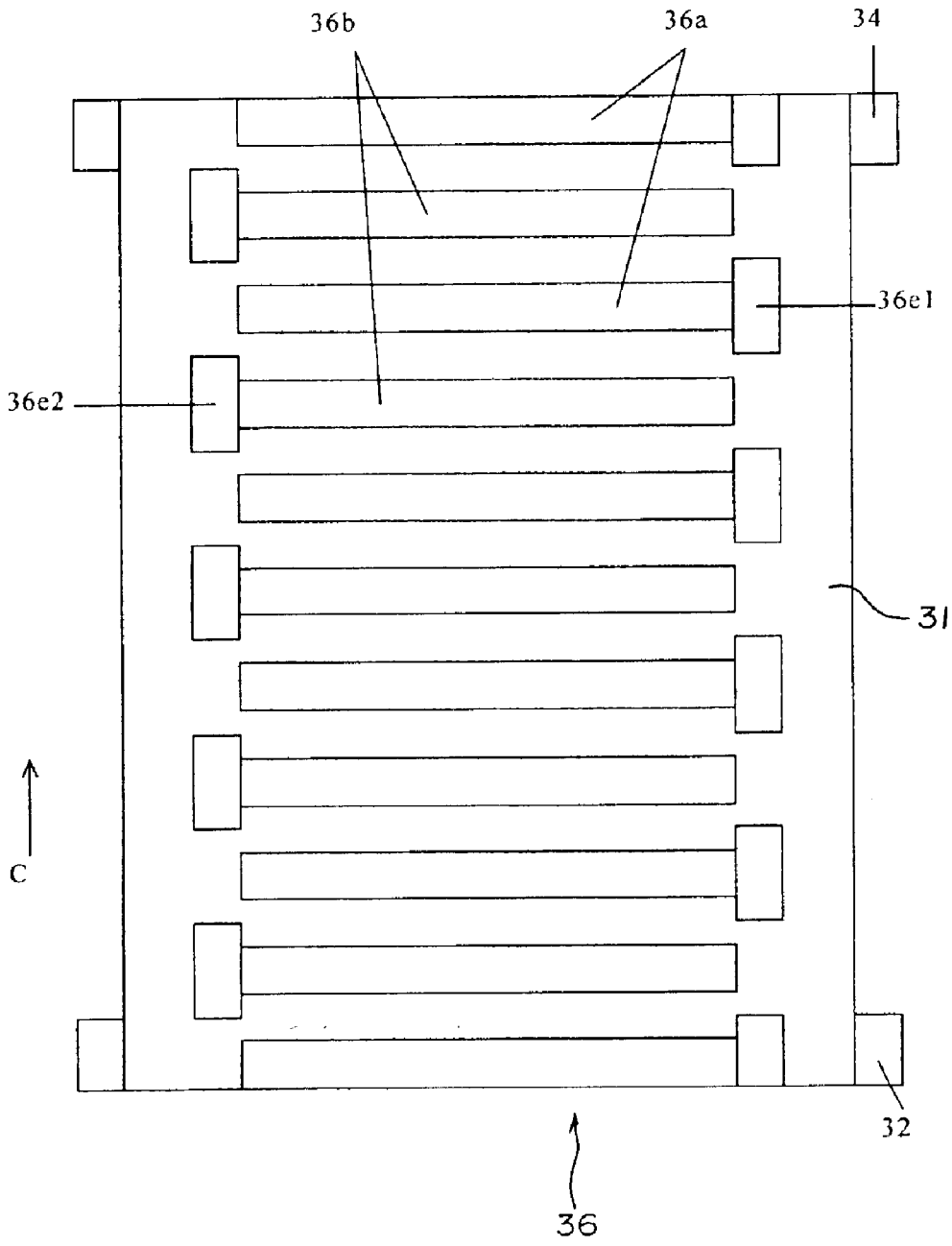
FIG. 3 is a top plan view showing a conveyance belt.

FIG. 3 is an explanatory view showing a conveyance belt 31 and an attraction force generating means 36. FIG. 3 shows the belt when the apparatus body is seen directly from above. The attraction force generating means 36 includes the first electrodes 36*a* and the second electrodes 36*b*. The first electrodes 36*a* and the second electrodes 36*b* have strip-like shapes and are plurally aligned parallel to each other in the width direction of the conveyance belt 31. The first electrodes 36*a* and the second electrodes 36*b* face each other in a direction perpendicularly intersecting with the conveying direction of the belt to form a comb-teeth shape.

A voltage receiving portion 36*e*1 of the first electrodes 36*a* (first voltage receiving portion) and a voltage receiving portion 36*e*2 of the second electrodes 36*a* (second voltage receiving portion), having a length longer than the width of each electrode 36*a*, 36*b*, are arranged on both sides of the conveyance belt 31 with respect to a conveying direction, and thereby positioning the voltage receiving portion 36*e*1 on a right end side with respect to the conveying direction of the conveyance belt 31 and the voltage receiving portion 36*e*2 on a left side with respect to the conveying direction of the conveyance belt 31. The attraction force generating means 36 also includes a conductive voltage supplying brush 51 for contacting with each voltage receiving portion 36*e* with a prescribed pressure.

An AC voltage biased with a positive bias voltage from a high voltage electric source (not shown) is applied to the voltage receiving portion 36*e*1 via the voltage supplying brush 51. An AC voltage biased with a negative bias voltage is applied to the voltage receiving portion 36*e*2. It is to be noted that the voltage supplying brush 51 is preferably made of a conductive material having a volume resistivity no more than $10^5$ Ohms-cm.

Figure 4:
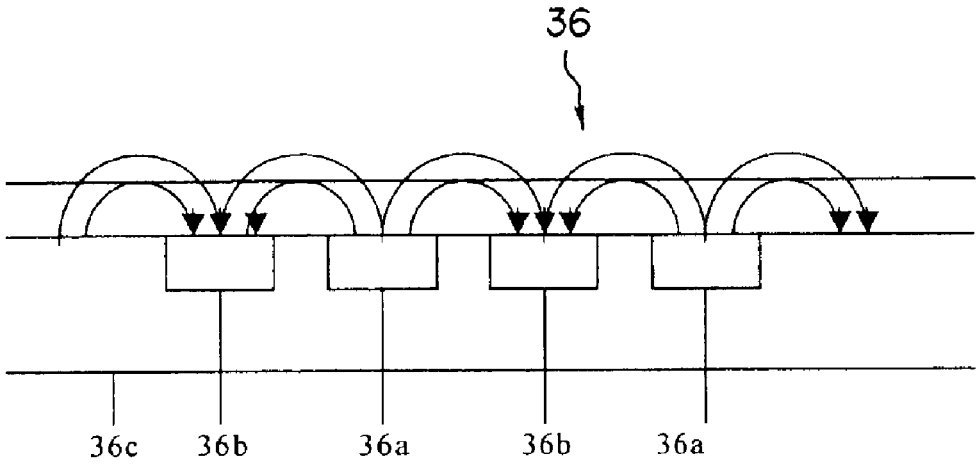
FIG. 4 is an explanatory view showing an interior of a conveyance belt.

FIG. 4 is a view for explaining the generation of attraction force by the attraction force generating means 36. When electric voltage is applied to the first electrodes 36*a*, an electric force is created in the arrow direction, thereby forming an electricity field line. From the electric potential difference between the first electrodes 36*a* and the second electrodes 36*b*, attraction force is created at the upper side of the conveyance belt 31 allowing the recording paper P on the conveyance belt 31 to be attracted to the conveyance belt 31. Since the surface layer 36*d* in this invention has a higher volume resistivity than that of the base layer 36*c*, the electricity field line and the sheet attraction force can be generated greater at the upper side of the conveyance belt 31.

Figure 5:
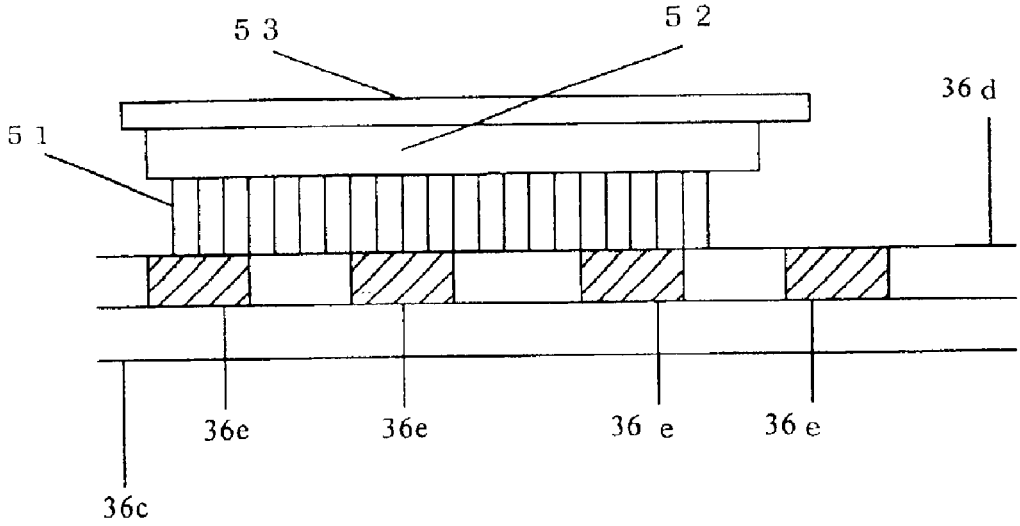
FIG. 5 is an explanatory view showing an attraction force generating means.

FIG. 5 is an explanatory view of a voltage supplying means supplying electricity to a conveyance belt. The attraction force generating means 36 comprises the first electrodes 36*a*, the second electrodes 36*b*, formed from conductive material respectively, the base layer 36*c*, the surface layer 36*d*, the voltage receiving portion 36*e*, the voltage supplying brush 51, the voltage supplying electrode 52, and the support member 53. The voltage receiving portion 36*e* is disposed to share a same plane with the surface layer 36*d*. The voltage supplying brush 51 contacts the voltage receiving portion 36*e* with a certain pressure and supplies voltage thereto. The base layer 36*c* and the surface layer 36*d*, which are formed from dielectric material, have the first electrode 36*a* and the second electrode 36*b* protectively disposed therebetween.

The base layer 36*c* has a volume resistivity from $10^{12}$ Ohms-cm to $10^{17}$ Ohms-cm, and the surface layer 36*d* has a volume resistivity from $10^9$ Ohms-cm to $10^{14}$ Ohms-cm, and both are formed from a synthetic resin such as polyethylene, polypropylene, polyamide, polycarbonate, PTFE (polytetrafluoroethylene), PFE (polyfluoroethylene), PVDF (polyvinylidene fluoride), polyimide, or silicone resin. The voltage receiving portion 36*e* has a volume resistivity from $10^{-1}$ Ohms-cm to $10^5$ Ohms-cm and is formed from a conductive synthetic resin comprising carbon, or a conductive paste mixed with silver or copper powder. The water repellency for the surface layer 36*d* and the top surface of the voltage receiving portion 36*e* can be further improved by applying, for example, a fluororesin process thereto.

Figure 6:
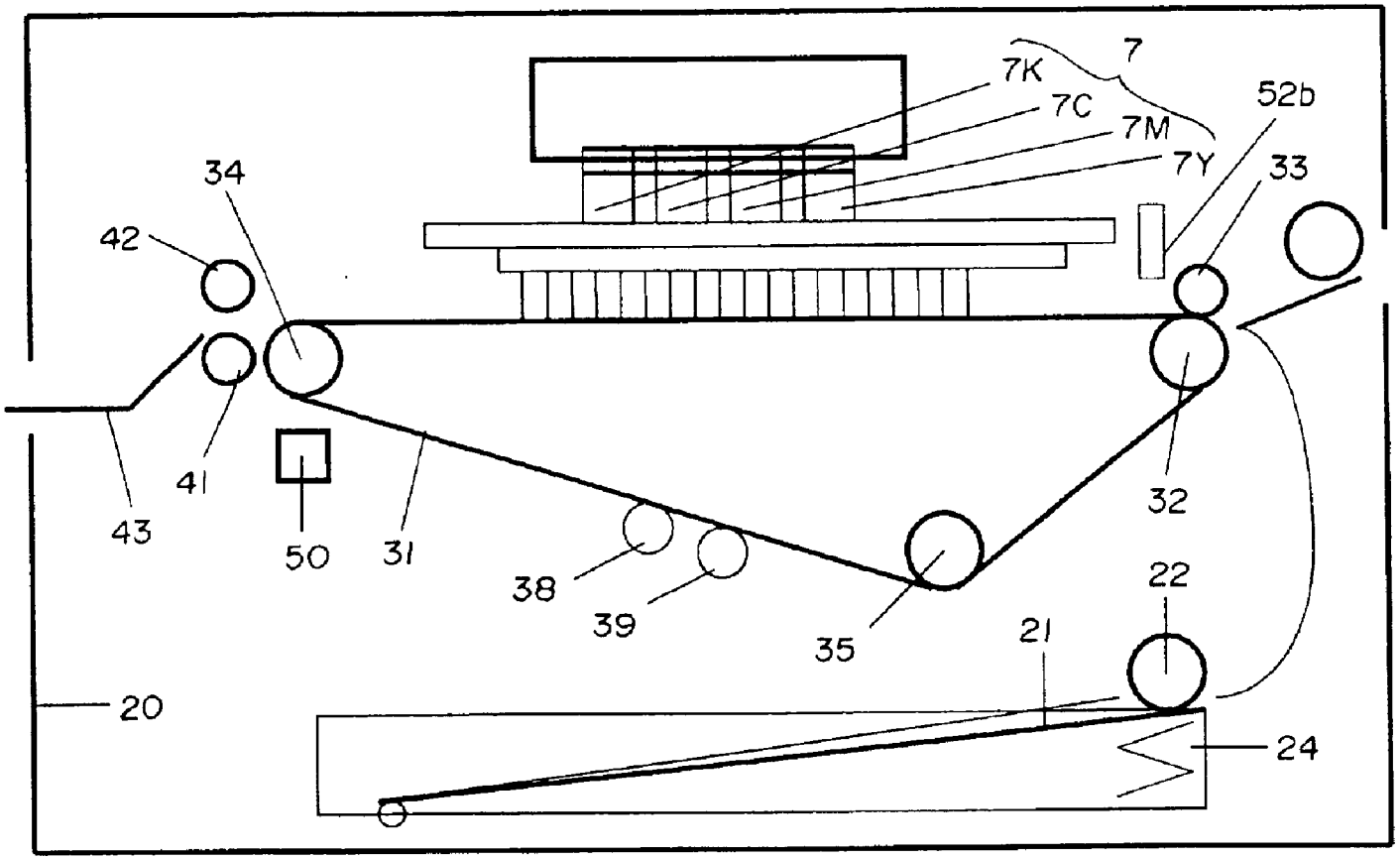
FIG. 6 is a view showing an overall mechanical structure of a recording apparatus.

FIG. 6 is a cross-sectional view showing an overall structure of a recording apparatus of this invention. In the feeding section, a pushing plate 21 for stacking recording paper P and a feeding rotary body 22 for feeding recording paper P are attached to a base 20, and the pushing plate 21 is rotatable around a rotation axis engaged to the base 20 and is pushed by a pushing plate spring 24 toward the feeding rotary body 22. The pushing plate 21 has a separation pad (not shown) with a high frictional coefficient for preventing double-feed of recording paper P and a separation nail-member (not shown) for separating the recording paper P. A release cam (not shown) is provided at the base 20 for disengaging the contact between the pushing plate 21 and the feeding rotary body 22.

With this structure, during a standby mode, the release cam presses down the pushing plate 21, thereby disengaging the contact between the pushing plate 21 and the feeding rotary body 22. When a drive force of the conveyance roller 32, while in this state, is transmitted to the feeding rotary body 22 and the release cam through gears or the like, the pushing plate 21 moves up to allow the feeding rotary body 22 to contact with the recording paper P. The apparatus then starts sheet feeding upon picking up the recording paper P along with the rotation of the feeding rotary body 22. The feeding rotary body 22 continues to rotate until the recording paper P is delivered to the conveyance section.

The conveyance section serving to attract the recording paper P includes a conveyance belt 31 for sheet conveyance and an unshown PE (paper end) sensor. The conveyance belt 31 is driven by a driving roller 34 and is tensely wound around the conveyance roller 32 and a pressure roller 35, which serve as driven rollers. The driving source of driving roller 34 is a belt motor 50.

The conveyance belt 31 is formed from a synthetic resin such as polyethylene, polypropylene, polyamide, polycarbonate, PTFE (polytetrafluoroethylene), PFE (polyfluoroethylene), PVDF (polyvinylidene fluoride), polyimide, or silicone resin and is shaped as an endless belt. The voltage supplying means has been earlier described in detail with reference to other drawings.

The voltage supplying means applies a DC bias voltage of approximately 100V±3 kV superimposed on an AC voltage for allowing the recording paper P to be closely attracted to the conveyance belt 31. In terms of the relation between the DC bias voltage and the AC voltage in such a case, the peak value of the AC voltage is preferably no more than 3 times the DC bias voltage, and more preferably no more than the DC bias voltage since an exceedingly high AC voltage swinging greatly toward the opposite potential weakens the attraction force. The peak value of the AC voltage is preferably no less than ⅓ times the DC bias voltage, and more preferably no less than ½ times the DC bias voltage since an exceedingly low AC voltage weakens the effect of equalizing the surface potential of the recording paper. (The explanation for a high voltage generating means and a high voltage control means will be omitted.) It is to be noted that the conveyance belt is moved at a speed of 170 mm per second.

The conveyance belt 31 and a pinch roller 33 driven by the conveyance roller 32 make contact in a position opposite from the conveyance roller 32. The recording head 7 (the recording head 7Y is for yellow, a recording head 7M is for magenta, a recording head 7C is for cyan, and the recording head 7K is for black) is disposed downstream in the conveying direction of the conveyance roller 32. The recording head 7, which is a line-type inkjet recording head having plural nozzles arrayed in a direction perpendicularly intersecting the conveying direction, uses a line-type head having a row of nozzles whose length is the same as or greater than the sheet width. The recording head 7, which is also a thermal type recording head, applies heat to ink with a heater or the like. The ink is subject to film boiling by the heat, and pressure change created by growing and shrinking of vapor bubbles caused by the film boiling makes the nozzles discharge the ink, thereby forming an image on the recording paper P. It is to be noted that the resolution in recording with the recording head is 600 dpi.

The delivery section comprises a delivery roller 41 and a spur 42. The recording paper P having an image formed thereon is delivered to a delivery tray 43 by being conveyed in a manner nipped between the delivery roller 41 and the spur 42. It is to be noted that the area in which the spur contacts the recording paper P is small, and therefore, the spur 42 serving as a rotating member has no adverse effect on an ink image even when ejection of ink causes the ink image to contact with a side of the recording paper P upon which the image has been recorded.

Numeral 38 is a cleaning roller used for cleaning the belt 31. Numeral 39 is a de-electrifying brush used for earthing or grounding the charge remaining on the belt and for enabling easy sheet delivery. The belt motor 50 serves as a driving source for rotating the conveyance belt.

In this embodiment, a bias voltage of ±750 V superimposed on a sinusoidal wave voltage having an amplitude of 1500 V is applied to the positive electrodes and negative electrodes, respectively. The frequency of the sinusoidal wave in this case was 2500 Hz.

In changing the voltage applied to the electrodes, it is preferable to change the voltage in a manner where there would be at least two or more maximum values of the surface potential while a single electrode passes underneath the recording head.

In recording various images with the recording apparatus under the above settings for one hour, no irregularity was found in sheet conveyance, and the recording apparatus was able to ensure steady operation. The recording apparatus was able to record with a high quality with no mist accumulated on the surface of the recording paper P.

Examples for solving the problem of images stained by ink mist attracted in the vicinity of an electrode are disclosed in Japanese Patent Laid-Open Publication No. Hei 5-8392, in which an electrode is arranged contacting a recording paper, and an electrode is arranged surrounding an ink discharging port for controlling the ink. However, the conveyance belt for the invention described in the publication is different from the belt with a comb-teeth electrode of the present invention; that is, the conveyance belt for the invention described in the publication is a type that attracts the recording paper by accumulating electrical charge on the surface of the belt.

As a result of various attempts in attracting and conveying a recording paper by using a comb-teeth electrode, a waveform voltage, which is changed along with the lapse of time, is employed in this invention as the voltage applied to each electrode for generating attraction force. In one experiment, for example, an AC voltage biased with a DC bias voltage (various voltages which are combinations of a sinusoidal wave, a triangular wave, a serrate wave, a square wave, or a rectified wave of such waveforms, etc.) was supplied to the electrodes to serve as an attraction voltage allowing the positive electrode to constantly have positive electric potential and the negative electrode to constantly have negative electric potential. In consequence, the surface potential of the recording paper with respect to the attracted portion of the recording paper not only swung toward positive potential but also swung toward negative potential even at a position above the positive electrode, and swung not only toward negative potential but also toward positive potential even at a position above the negative electrode. That is, an AC voltage or the like biased with a DC bias voltage allows to change the surface potential of the recording paper and create an indefinite surface potential of the recording paper, thereby preventing adherence of ink mist and impact deviation of ink droplets.

Second Embodiment

A new belt was attached to the apparatus of the first embodiment. In this embodiment, bias voltages of ±500 V, ±1000 V, and ±1500 V superimposed on sinusoidal waves voltages with amplitudes of 500 V, 1000 V, and 1500V are applied to the positive and negative electrodes. In such a case, a conveyance experiment was performed by changing the AC frequency to 50 Hz, 100 Hz, 250 Hz, 500 Hz, 1000 Hz, and 2000 Hz.

Figure 7:
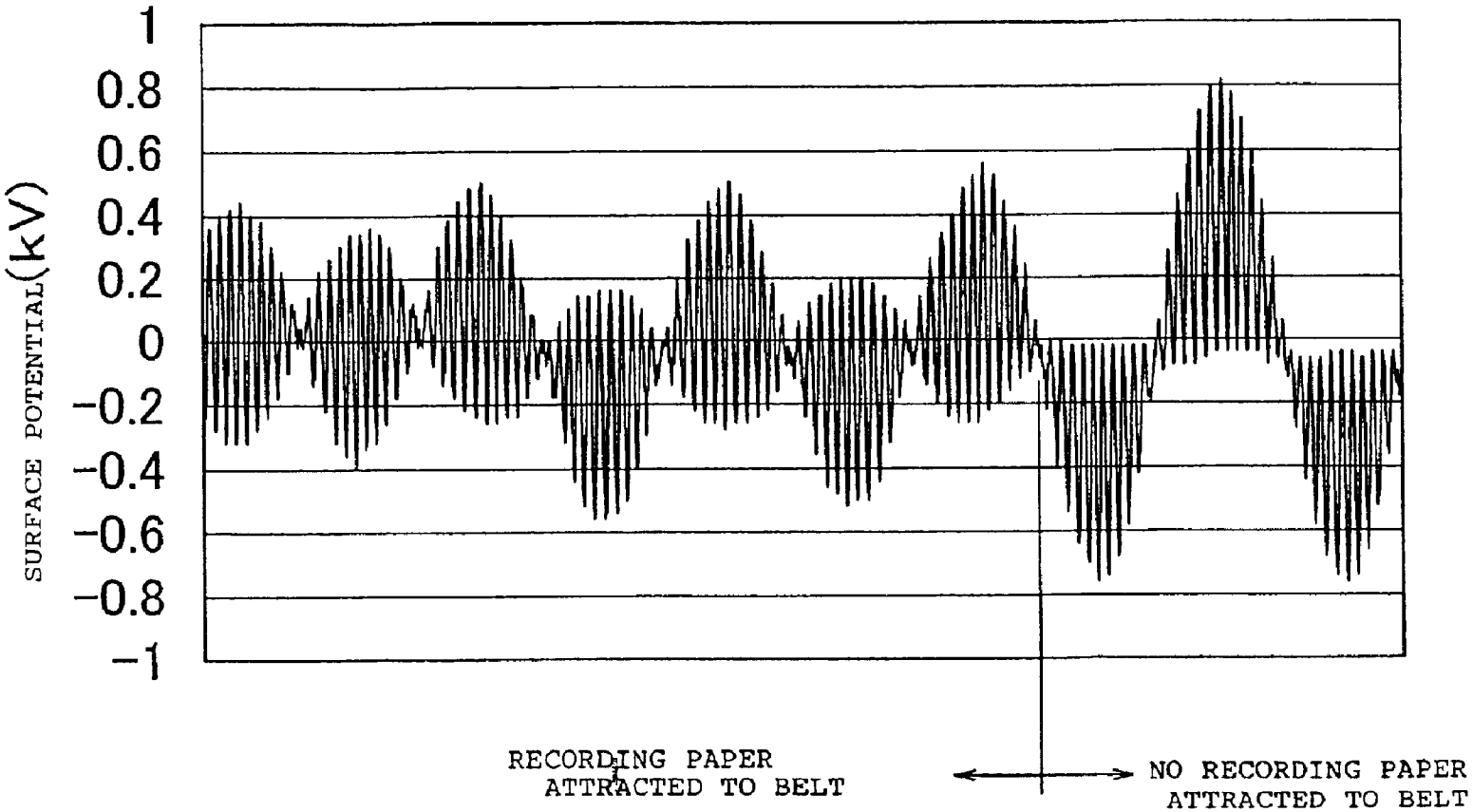
FIG. 7 is a view showing a result of measuring the electric potential of a belt surface.

In the experiment, FIG. 7 shows a result of measuring the surface potential of the conveyance belt when a recording paper is attracted to the conveyance belt under the conditions where a bias voltage of ±500 V is superimposed on a sinusoidal wave with an amplitude of 1000 V. FIG. 7 is one example showing a result of measuring the surface potential of the belt in using the conveying method of this embodiment. The waveforms swing toward positive or negative at the portions of the electrodes where no recording paper is attached to the belt, and yet, the surface potential swings toward both positive and negative at the portions where the recording paper is attached to the belt. This restrains electrically charged mist from concentrating on a single portion of the recording paper. Therefore, concentration of mist and impact deviation of ink droplets can be prevented.

In recording various images upon two thousand sheets with each of the frequencies, no irregularity was found in sheet conveyance, and the recording apparatus was able to ensure steady operation with all of the frequencies. However, when the frequency is 50 Hz, from which a value (V/f) no less than 2 can be extracted when dividing the moving speed of the conveyance belt V (mm/s) by the frequency of the AC voltage f (Hz), the load change upon the motor is greater in comparison with other conditions, and when the frequency is 2000 Hz, the attraction force tends to be weaker in comparison with other conditions. The attraction force also tends to be weaker in comparison with other conditions when a bias voltage of ±500 V is superimposed on a sinusoidal wave with an amplitude of 1500 V. The impact deviation of ink droplets, though being visible at slight portions through a microscope, is hardly visible through the naked eye when a bias voltage of ±1500 V is superimposed on a sinusoidal wave with an amplitude of 500 V. Furthermore, recording of high quality is provided with no mist accumulated on the surface of the recording paper and with no blurring of images from impact deviation of ink droplets.

COMPARATIVE EXAMPLE

In this example, the belt used in the second embodiment is attached to the apparatus in the first embodiment, in which recording and conveying were tested by applying DC voltages of ±500 V, ±1000 V, ±1500 V, and ±2000 V to the positive and negative electrodes. In recording various images upon 50 sheets with each of the voltages, adherence of ink mist corresponding to the arrangement of the electrodes could be visually recognized through the naked eye in part of the images. This becomes more significant as the voltage becomes higher. When the voltage is ±1500 V or more, blurring of images from impact deviation of ink droplets could also be visually recognized through the naked eye.

Other Embodiments

This invention is not to be restricted to the foregoing embodiments in which the voltage receiving portion **36*e*1 of the first electrode 36*a* is disposed on one end of the conveyance belt 31 while the voltage receiving portion 36*e*2 is disposed on the opposite end of the conveyance belt 31**.

The voltage receiving portion 36e1 of the first electrode 36a and the voltage receiving portion 36e2 of the second electrode 36b can also be disposed on the same end of the conveyance belt 31.

What is claimed is:

1. A sheet conveying apparatus for conveying and attracting a sheet with electrostatic force, comprising:

a conveyance belt for conveying by attracting and supporting a sheet;

a plurality of electrodes integrally formed with said conveyance belt, said electrodes moving integrally with said conveyance belt; and voltage supplying means for supplying an AC voltage biased with a DC voltage to said plurality of electrodes so as to generate an attraction force by a difference of voltages between adjacent electrodes, wherein the potential of a predetermined portion of a surface of said conveyance belt swings.

2. The sheet conveying apparatus according to claim 1, wherein the voltage applied to the electrodes is an AC voltage biased with a DC bias voltage including combinations of a sinusoidal wave, a triangular wave, a serrate wave, a square wave, other waves or a rectified wave of such waveforms.

3. The sheet conveying apparatus according to claim 2, wherein a relation of $\frac{1}{3}$ Vb≦V≦3 Vb is satisfied, in which V indicates the amplitude of the AC voltage, and Vb indicates the DC bias voltage.

4. The sheet conveying apparatus according to claim 2, wherein the electrodes perpendicularly intersect with the conveying direction of said conveyance belt and form a comb-teeth shape, and wherein each electrode is applied with the AC voltage biased with the DC bias voltage, in which the polarity of the DC bias voltage for one electrode is different from that of another adjacent electrode.

5. A recording apparatus for recording on a sheet comprising a sheet conveying apparatus according to claim 1.

6. The recording apparatus according to claim 5, further comprising a recording head which records by discharging ink according to a signal.

7. The recording apparatus according to claim 6, wherein the recording head has a row of nozzles whose length is the same as or greater than the width of the sheet.

8. A recording apparatus comprising:

a recording head having a row of nozzles whose length is the same as or greater than the width of a sheet; and a sheet conveyance belt having comb-teeth shaped electrodes perpendicularly intersecting with the sheet conveying direction, the electrodes being formed integrally with said conveyance belt and moving with said conveyance belt, wherein the voltage applied to the electrodes includes at least an AC voltage and is so changed to create at least two maximum values of a surface potential while one of the electrodes passes underneath the recording head, and wherein the potential of a predetermined portion of a surface of said conveyance belt swings.

9. A recording apparatus comprising:

a recording head having a row of nozzles whose length is the same as or greater than the width of a sheet;

a conveyance belt for conveying by attracting and supporting a sheet;

a plurality of electrodes being formed integrally with said conveyance belt, said electrodes moving with said conveyance belt; and voltage supplying means for supplying voltage to said electrodes, wherein said electrodes are comprised of first electrodes and second electrodes, said first electrodes and second electrodes being applied with different potentials and each having a strip-like shape, wherein a sheet attracting conveying apparatus is formed of a plurality of said first electrodes and said second electrodes arranged alternately in a direction perpendicularly intersecting with respect to a moving direction of said conveyance belt for forming a comb-teeth shape, wherein each electrode is applied with an AC voltage biased with a DC bias voltage, in which the polarity of the DC bias voltage for one electrode is different from that of another adjacent electrode, wherein the value (V/f) extracted from dividing the moving speed of the conveyance belt V (mm/s) by the frequency of the AC voltage f (Hz) is no more than 2, and wherein the potential of a predetermined portion of a surface of said conveyance belt swings.

10. A sheet conveyance apparatus, comprising:

a conveyance belt for conveying by attracting and supporting a sheet;

a plurality of electrodes integrally formed with said conveyance belt, wherein said electrodes move integrally with said conveyance belt; and voltage supplying means for supplying AC voltage biased with a DC bias voltage to said plurality of electrodes so as to generate an attraction force by a difference of voltages between adjacent electrodes, wherein the potential of a predetermined portion of a surface of said conveyance belt swings.

11. A sheet conveyance apparatus according to claim 10, wherein a relation of $\frac{1}{3}$ Vb≦V≦3 Vb is satisfied, in which V indicates the amplitude of the AC voltage, and Vb indicates the DC bias voltage.

12. A sheet conveyance apparatus according to claim 11, wherein said electrodes perpendicularly intersect with the conveying direction of said conveyance belt and form a comb-teeth shape; and wherein each electrode is applied with the AC voltage biased with the DC bias voltage, in which the polarity of the DC bias voltage for one electrode is different from that of another adjacent electrode.

13. A recording apparatus for recording on a sheet with ink discharged from a recording head at a predetermined recording position, comprising:

a conveyance belt for conveying and supporting a sheet;

a plurality of electrodes integrally formed with said conveyance belt, wherein said electrodes move integrally with said conveyance belt; and voltage supplying means for supplying AC voltage biased with a DC bias voltage to said plurality of electrodes so as to generate an attraction force by a difference of voltages between adjacent electrodes, wherein the potential of a predetermined portion of a surface of said conveyance belt swings to both negative potential and positive potential.

14. A recording apparatus according to claim 13, wherein recording on a sheet is effected by ink discharged from the recording head according to a recording signal.

15. A recording apparatus according to claim 14, wherein the recording head has a row of nozzles whose length is the same as or greater than the width of the sheet.

16. A recording apparatus according to claim 15, wherein the recording head comprises a thermal type recording head.

17. A sheet conveyance apparatus, comprising:

a conveyance belt for conveying a sheet;

a first group of plural electrodes integrally arranged with said conveyance belt;

a second group of plural electrodes integrally arranged with said conveyance belt and between the electrodes of said first group of plural electrodes; and voltage supplying means for supplying an AC voltage adding positive bias to said first group of plural electrodes and an AC voltage adding negative bias to said second group of plural electrodes, wherein each of said first and second groups of electrodes moves with said conveyance belt while being supplied the voltage by said voltage supplying means, and wherein the potential of a predetermined portion of a surface of said conveyance belt swings.

18. A sheet conveyance apparatus according to claim 17, wherein the sheet is attracted to said conveyance belt by a difference of the voltage between said first group of plural electrodes and said second group of plural electrodes.

19. A recording apparatus for recording on a sheet with ink discharged from a recording head at a predetermined recording position, comprising:

a conveyance belt for conveying the sheet;

a first group of plural electrodes integrally arranged with said conveyance belt;

a second group of plural electrodes integrally arranged with said conveyance belt and each electrode of said second group of plural electrodes is arranged between the electrodes of said first group of plural electrodes; and voltage supplying means for supplying an AC voltage adding positive bias to said first group of plural electrodes and an AC voltage adding negative bias to said second group of plural electrodes, wherein each of said first and second groups of electrodes passes the recording position with said conveyance belt while being supplied the voltage by said voltage supplying means, and wherein the potential of a predetermined portion of a surface of said conveyance belt swings.

* * * * *